United States Patent [19]

Ochiai

[11] Patent Number: 4,555,192

[45] Date of Patent: Nov. 26, 1985

[54] RELEASE TYPE DOT PRINTER HEAD

[75] Inventor: Kuniaki Ochiai, Shizuoka, Japan

[73] Assignee: Tokyo Electric Co., Ltd., Tokyo, Japan

[21] Appl. No.: 582,715

[22] Filed: Feb. 23, 1984

[30] Foreign Application Priority Data

Feb. 25, 1983 [JP] Japan ..... 58-31395
Feb. 28, 1983 [JP] Japan ..... 58-33613

[51] Int. Cl.[4] ..... B41J 3/12

[52] U.S. Cl. ..... 400/124; 101/93.05; 335/274

[58] Field of Search ..... 400/124; 101/93.05; 335/274

[56] References Cited

U.S. PATENT DOCUMENTS 4,016,965 4/1977 Wirth et al. ..... 400/124
4,049,107 9/1977 Murat ..... 400/124
4,240,756 12/1980 Ku et al. ..... 400/124

FOREIGN PATENT DOCUMENTS 51568 4/1980 Japan ..... 400/124
110462 7/1982 Japan ..... 400/124
215364 12/1983 Japan ..... 400/124
2071019 9/1981 United Kingdom ..... 400/124

*Primary Examiner*—Paul T. Sewell
*Attorney, Agent, or Firm*—Oblon, Fisher, Spivak, McClelland & Maier

[57] ABSTRACT

The present invention provides a release type dot printer head wherein an urging force of an armature in a printing direction for driving a print needle is exerted by a non-linear spring such as a conical spring. Hence, the urging force can correspond to a variation of an attracting force of the armature by a permanent magnet. Consequently, an energizing current for a coil can be reduced, and thus high speed printing can be attained by the arrangement.

14 Claims, 9 Drawing Figures

RELEASE TYPE DOT PRINTER HEAD

FIELD OF THE INVENTION

This invention relates to a dot printer, and more particularly to a release type dot printer head in which an armature for driving a needle is normally attracted bu a permanent magnet and is released, upon energization of a coil, from an attracting force of the permanent magnet so that it is moved by a force of a spring to effect a printing operation by the needle.

OBJECT OF THE INVENTION

It is a first object of the present invention to provide a release type dot printer head wherein a releasing force is produced in accordance with a non-linearly changing attracting force of an armature by a permanent magnet.

It is a second object of the invention to provide a release type dot printer head wherein a non-linearly varying releasing force is provided by a spring.

It is a third object of the invention to provide a release type dot printer head wherein a moment of inertia of an armature is reduced.

It is a fourth object of the invention to provide a release type dot printer head which attains printing at a high speed.

It is a fifth object of the invention to provide a release type dot printer head wherein a stroke of an armature is limited within a predetermined range even upon lost printing.

It is a sixth object of the invention to provide a release type dot printer head wherein power consumption is reduced.

Other objects of the present invention will become apparent from the following description.

DECRIPTION OF THE PRIOR ART

Figure 1:
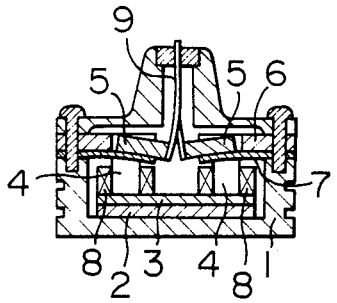
FIG. 1 PRIOR ART
FIG. 1 is a vertical sectional view of a typical one of conventional release type dot printer heads.
Figure 2:
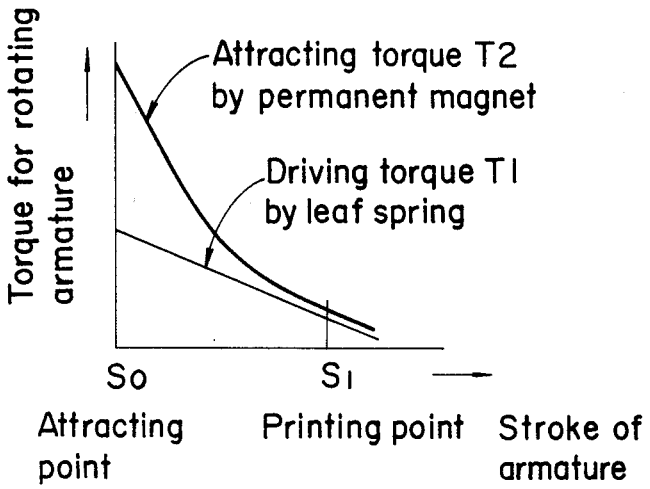
FIG. 2 PRIOR ART
FIG. 2 is a diagram showing changes of an attracting torque by a permanent magnet and a driving torque by a leaf spring of the head of FIG. 1.

Reference is first had to FIG. 1 which shows, as a typical one of conventional release type dot printer head, an arrangement disclosed in Japanese laid-open Pat. No. 57-49576. The dot printer head includes a casing 1, a permanent magnet 2, a yoke 3, cores 4, armatures 5 and a magnetic member 6 with a closed magnetic path cooperatively defined by the casing 1, the permanent magnet 2, the yoke 3, each of the cores 4, each of the armatures 5 and the magnetic member 6. Each of the armature 5 is held on a leaf spring 7 which is clamped between the magnetic member 6 and the casing 1. The armature 5 is normally attracted to the core 4 against the urging of the leaf spring 7, and when a coil 8 is energized, the armature 5 is released from a magnetic flux of the permanent magnet 2 and is moved in a printing direction by a force of the leaf spring 7 to move a needle 9 into impact with a platen (not shown). After then, the coil 8 is deenergized to allow the magnetic force of the permanent magnet 2 to attract the armature 5 to the core 4 again.

This arrangement must necessarily be conditioned such that, in a stroke S0 to S1 of the armature 5 from a position in which it is at rest to another position in which the needle 9 is brought into impact with the platen, attracting torque T2 of the armature 5 by the permanent magnet 5 is always greater than driving torque T1 of the armature 5 by the leaf spring 7.

However, the torque T1 for moving the armature 5 in the printing direction presents a linear change due to the fact that it is exerted from the leaf spring 7, and hence, in order to maintain the condition $T1<T2$ within the range from S0 to S2, the difference between T1 and T2 must inevitably be considerably great. In other words, the driving torque T1 is relatively low, resulting in printing at a low speed. Besides, in order to cancel or offset such a high attracting torque T2 of the permanent magnet 2, the coil 8 must have a great magnetomotive force, resulting in a defect that power consumption is high.

Figure 3:
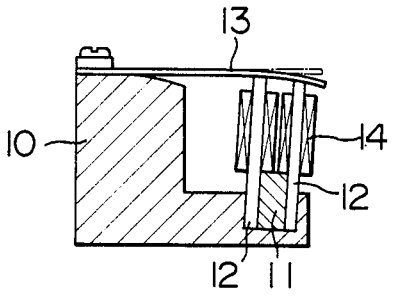
FIG. 3 PRIOR ART
FIGS. 3 and 4 are partial vertical sectional views showing a different example of conventional release type dot printer heads.
Figure 4:
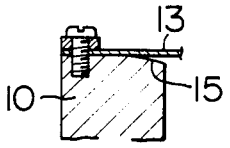
FIG. 4 PRIOR ART
Figure 5:
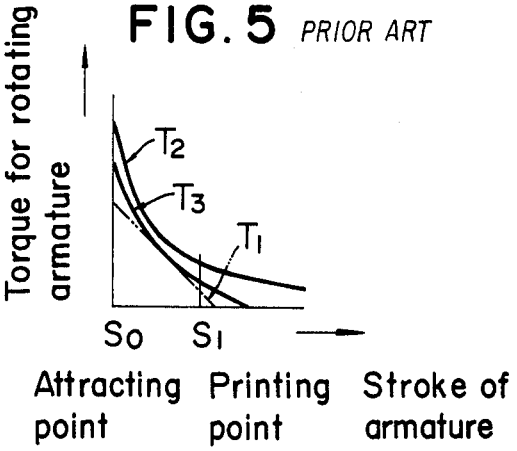
FIG. 5 PRIOR ART
FIG. 5 is a diagram showing changes of an attracting torque by a permanent magnet and a driving torque by a leaf spring of the head of FIGS. 3 and 4.

Reference is now had to FIGS. 3 and 4 which illustrate another conventional release type dot printer head which is disclosed in Japanese laid-open Pat. No. 55-103978. The dot printer head includes a frame 10, a permanent magnet 11, a plurality of pairs of cores 12, and a plurality of armatures 13 each formed as a leaf spring secured to the frame 10, which all cooperate to define closed magnetic paths. Each of the armature 13 is normally attracted to the cores 12 and when associated coils 14 are energized, it is released from a magnetic flux of the permanent magnet 11 and moves in a printing direction by an elastic force of the armature 13 itself. Since the armature 13 formed from a leaf spring is supported by an arcuate or rounded face 15 of the frame 10, the fulcrum at which the armature 13 is supported changes successively in the course of flexing movement of the armature 13. Due to this arrangement, change of the driving torque T3 of the armature 13 can come near to change of the attracting torque T2 by the permanent magnet 11, as seen in FIG. 5. The driving torque T1 by a leaf spring arrangement similar to that of FIG. 1 is also indicated on the diagram of FIG. 5 for the purpose of comparison, and from such comparison, it is apparent that the arrangement of FIGS. 3 and 4 is improved relative to that of FIG. 1.

In the arrangement of FIGS. 3 and 4, however, since a portion of the magnetic path which is shared by the armature 13 formed as a leaf spring is relatively long, the armature 13 which is thus very thin presents too small a cross sectional area for the magnetic path to assure a sufficient flux and thus a sufficient attractive force. Consequently, an elastic force of the leaf spring can be made sufficiently strong, and as a result, the printing speed cannot be increased. Further, the arcuate face 15 which supports the armature 13 for its flexing movement must necessarily be formed in accordance with the spring characteristics of the armature 13 formed as a leaf spring, and hence, the frame 10 cannot be produced easily. In order to resolve this problem, it may be advisable to securely mount a magnetic member on the armature 13 formed as a leaf spring to increase a cross sectional area for the magnetic path. But, this will result in increase of a moment of inertia of such a magnetic member and also in unstable operation because the magnetic member will be displaced around the fulcrum of the armature 13. In this way, the armature 13 will be flexed at a fixed point (fulcrum) thereof, and hence, the stress will be concentrated to this point, resulting in reduction of durability of the dot printer head while increasing the number of component parts and the number of man-hours required for production of the same.

DESCRIPTION OF THE PREFERRED EMBODIMENTS

Figure 6:
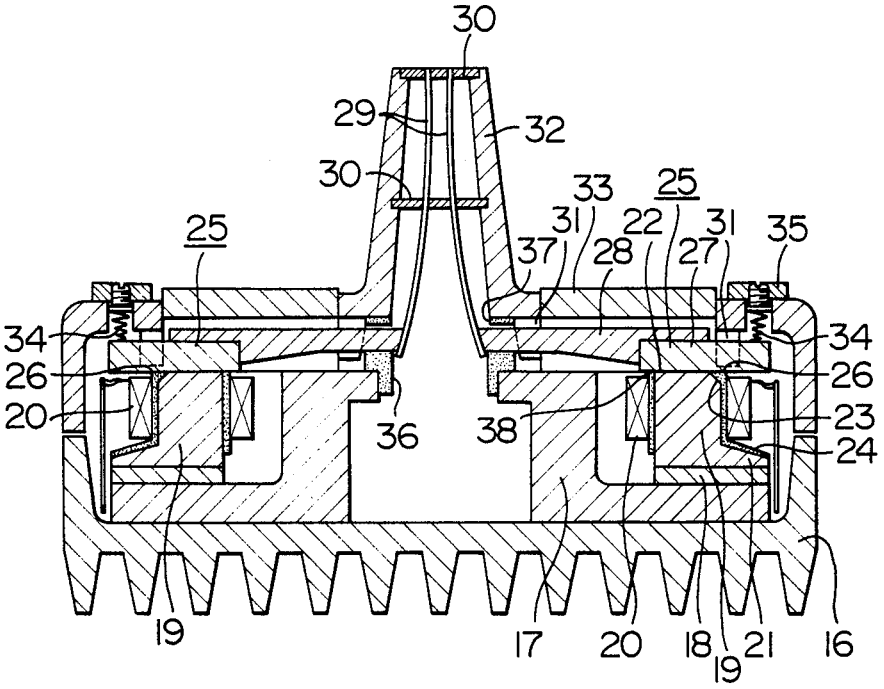
FIG. 6 is a vertical sectional view showing a first embodiment of the present invention.
Figure 7:
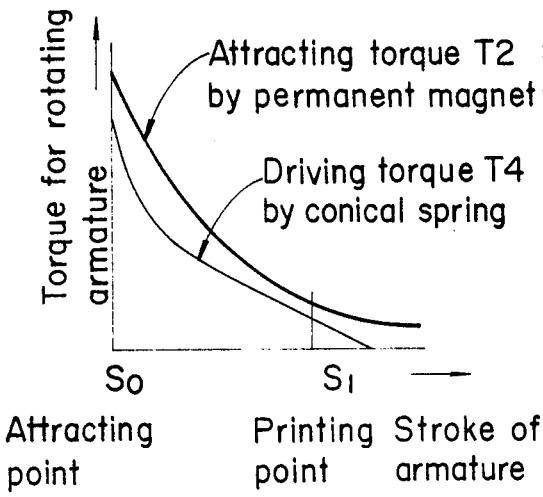
FIGS. 7 and 8 are diagrams illustrating changes of an attracting torque by a permanent magnet and a driving torque by a conical spring of the head of FIG. 6.

A first embodiment of the present invention will now be described with reference to FIGS. 6 to 8. The release type dot printer head includes a casing 16 to which an annular yoke 17 is secured. A doughnut-shaped permanent magnet 18 is secured to an upper face adjacent an outer periphery of the yoke 17, and a plurality of cores 19 are secured to an upper face of the permanent magnet 18. Each of the cores 19 has a coil 20 mounted thereon and has a substantially L-shaped configuration such that it presents an equal horizontal sectional area along the entire portion thereof on which the coil 20 is mounted while it presents an increased horizontal cross sectional area at a mounting base portion 21 thereof at which it is mounted on the permanent magnet 18. Each core 19 has an attracting face 22 at the top thereof and is beveled 23 along an outer side adjacent the attracting face 22 thereof. An outer peripheral surface of each core 19 is covered with a plastic material 24 of high strength such as PPS containing carbon fibers therein or the like. Accordingly, adjacent the outer one sides of the attracting faces 22, fulcrums 26 are formed by the plastic materials 24 for supporting armatures 25 on a plane. A layer of each plastic material 24 is made thicker at the fulcrum 26 thereof due to the presence of the beveling 23 of the core 19. The attracting faces 22 are formed by polishing together with one face of the yoke 17 after the plastic materials 24 are applied to the cores 19. Each of the armatures 25 is constituted as an assembly of a stamped part 27 made of a silicon steel material or the like and another stamped part 28 made of a carbon steel material or the like. A face of the former stamped part 27 adjacent the fulcrum 26 therefor is made flat. Meanwhile, the latter stamped part 28 has a reduced thickness of material to reduce its moment of inertia, but since the direction of the thickness thereof is perpendicular to the direction of operation of the armature 25, it still has a sufficient strength for such operation. A needle 29 is secured to an end of each armature 25.

The dot printer head further includes a guide holder 32 having thereon needle guides 30 for retaining the needles 29 and armature guides 31 for guiding opposite sides of the armatures 25. The guide holder 32 is provided with magnetic members 33 and has a holder plate 35 screwed thereto which holds one end of each of conical springs 34 which belong to a kind of non-linear spring. Each of the magnetic members 33 serves to form part of a side magnetic path from opposite sides of the armature 25 to the yoke 17. A stop 36 is secured to an inner periphery of the yoke 17 such that it may be abutted by the free ends of the armatures 25. Another stop 37 is also mounted on the guide holder 32 in opposing relationship to the stop 36.

In this construction, each of the armatures 25 is normally attracted to the attracting face 22 of the associated core 17 by a magnetic flux of the permanent magnet 18. Thus, if the coil 20 is energized in a direction to cancel or offset the magnetic flux of the permanent magnet 18, the armature 25 is allowed to be pivoted about the fulcrum 26 by the force of the conical spring 34 to move the needle 29 into impact with a platen (not shown). Since energization of the coil 20 continues only momentarily, the armature 25 is immediately returned by the magnetic flux of the permanent magnet 18 to its original position in which it abuts against the attracting face 22 of the core 19. At this instant, the armature 25 tends to pivot, by its inertia in the returning motion, in opposite directions about a fulcrum provided by a side 38 of the core 19 opposite to the fulcrum 26. But such an excessive returning motion can be arrested effectively by means of the stop 36.

Thus, the conical spring 34 for urging the armature 25 is not involved in a magnetic circuit, and hence, a cross sectional area of a magnetic path which is provided by the core 19, the stamped part 27 of the armature 25, the magnetic member 33, and the yoke 17 can be made relatively great. Accordingly, the attracting torque T2 by the permanent magnet 18 can be increased, as seen from FIG. 7. Further, while the conical spring 34 presents a variation in the load thereof in the course of a flexing operation thereof, it has a characteristic to bring the torque T4 for driving the armature 25 near to the attracting torque T2 by the permanent magnet 18. In other words, when the coil 20 is energized to cancel the attracting torque T2, the armature 25 is operated at a high speed in the printing direction with a large torque T4. After interruption of energization of the coil 20, the armature 25 can be returned to its initial position at a high speed since the attracting torque T2 by the permanent magnet 18 is considerably large. Since the fulcrum 26 of the armature 25 is near the center of the core 19 and the stamped member 28 is thin, the center of gravity of the armature 25 is also near the fulcrum 26 and hence the moment of inertia of the armature is also small. Further, since the center of gravity of the armature 25 is near the fulcrum 26, a pivotal action of the armature about the fulcrum caused by an impact force for printing is extremely small, thus resulting in increase of the returning speed of the armature 25. Accordingly, it can also be made possible by such a high speed operation of the armature to reduce duration of energization of the coil 20 to save electric power.

Figure 8:
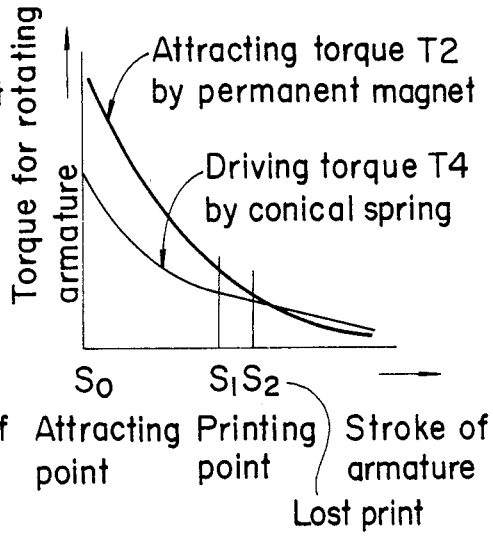

Further, in such a case that a lost printing operation is effected without a platen in order to assemble or adjust the dot printer head, the stroke for such lost printing of the armature 25 is limited to a small range between S1 and S2 as shown in FIG. 8, thereby allowing rapid attraction of the armature 25 by the permanent magnet 18. Accordingly, even if the attracting torque T2 by the permanent magnet 18 becomes greater than the driving torque T4 of the conical spring 34 where the stroke of the armature 25 exceeds S2 as seen in FIG. 8, there is no trouble, and thus, the conical spring 34 is allowed to have characteristics of a greater width, resulting in facilitation of design and production of a release type dot printer head.

It is to be noted that, since the stop 37 is not used normally, impact noises or durability need not be taken in consideration. The stop 37 may alternatively be formed integral with the guide holder 32.

Figure 9:
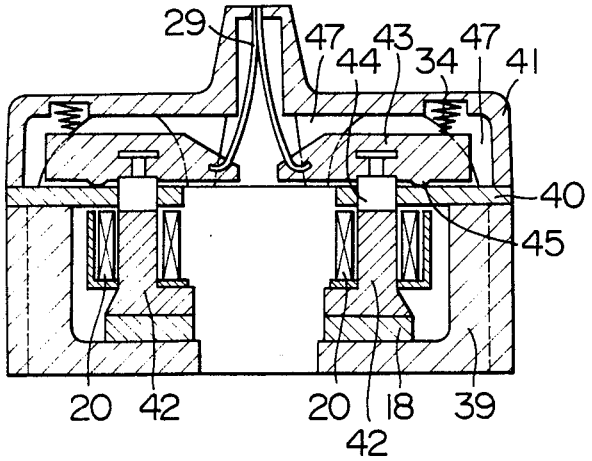
FIG. 9 is a vertical sectional view showing a second embodiment of the invention.

Now, a second embodiment of the present invention will be described with reference to FIG. 9. Like parts to those of the first embodiment are designated by like reference numerals, and thus description thereof will be omitted herein. The release type dot printer head of the second embodiment includes an assembly of a casing 39, a doughnut-shaped magnetic member 40, and a guide holder 41. Cores 42 each having a coil 20 mounted thereon is secured to a permanent magnet 18 in the form of a disk which is in turn secured to the casing 39. An armature 43 having a needle 29 mounted thereon has a plunger 44 made of a magnetic material and disposed in opposing relationship to each of the cores 42. The plunger 44 is supported for sliding movement in an axial direction thereof by means of the magnetic member 40. Further, the armature 43 has formed on a face thereof adjacent the core 42 a fulcrum 45 of a semicircular cross section at which the armature 43 is supported on the magnetic member 40. A conical spring 34 for urging the armature 43 in its printing direction is provided on the guide holder 41 on which the needle 29 is mounted, and a guide rib 47 is also formed on the guide holder 41 around the center of the fulcrum 45. The armature 43 has a curved face which has a radius coincident with that of the guide rib 47, thereby providing means for preventing a change of the position of the fulcrum 45.

In this construction, when the coil 20 is energized, the armature 43 is released from a magnetic flux of the permanent magnet 18 to thus allow a force of the conical spring 34 to operate the armature 43 in the printing direction. Also in the present embodiment, the driving torque T4 of the armature 43 by the conical spring 34 is relatively large. Further, the plunger 44 and the core 42 are in opposing relationship to each other over large areas thereof while the outer periphery of the plunger 44 is fitted in the magnetic member 40 which in turn is contacted with the casing 39 over large areas thereof. Accordingly, the cross sectional area of a magnetic path is large.

It is to be noted that, while in the embodiments described above a conical spring is employed as a non-linear spring, a ladder-shaped spring plate or a crown spring may otherwise be employed in practice.

Since a release type dot printer head of the present invention is constructed as described hereinabove, it is possible to increase a cross sectional area of a magnetic path to increase an attracting torque of an armature by a magnetic force of a permanent magnet, to increase a torque for driving the armature in a printing direction in accordance with characteristics of a conical spring to a degree to bring it near an attracting torque by the permanent magnet, and also to reduce a moment of inertia of the armature by an arrangement of the armature to allow pivotal motion thereof about a fulcrum positioned at a fixed position adjacent a core, whereby the speed of operation of the armature in the printing and returning direction can be made extremely high and as a result duration of energization of a coil can be reduced to save power consumption. The present invention further presents an effect that the armature can be returned rapidly even upon a lost printing operation by arresting an operation of the armature in the printing direction by means of a stop.

What is claimed is:

1. A release type dot printer head comprising:

(a) a casing;

(b) an annular yoke secured to said casing;

(c) a permanent magnet secured to an upper face of said annular yoke;

(d) a plurality of cores, each of said plurality of said cores being secured to an upper face of said permanent magnet and each of said plurality of cores having an attractive face at the top thereof and a fulcrum at the top outer edge thereof;

(e) a plurality of coils, each of said plurality of coils being wound around an associated one of said plurality of cores;

(f) a plurality of armatures, each of said plurality of armatures being disposed for pivotal movement about the fulcrum on the associated one of said plurality of cores;

(g) a plurality of needles, each of said plurality of needles being secured to the inward end of an associated one of said plurality of armatures;

(h) a plurality of magnetic members, one of said plurality of magnetic members being disposed on the opposite side of an associated one of said plurality of armatures from the associated one of said plurality of cores, each of said plurality of magnetic members serving as a part of a side magnetic path which also includes said yoke and the associated one of said plurality of armatures; and (i) a plurality of non-linear springs, each of said plurality of non-linear springs being disposed between an associated one of said plurality of armatures and an associated one of said plurality of magnetic members to resiliently bias the associated one of said armatures for pivotable movement about its fulcrum on the associated one of said cores against the attractive force of said permanent magnet, which attractive force acts on the associated one of said armatures through its attractive face, said plurality of non-linear springs not being in said side magnetic paths and each of said plurality of non-linear springs being selected so that the torque which it imparts to the associated one of said plurality of armatures as a function of the displacement of the associated one of said plurality of needles approximately the opposite torque imparted to the associated one of said plurality of needles by said permanent magnet.

2. A release type dot printer head as recited in claim 1, wherein each of said plurality of cores has an L-shaped configuration comprising an upper portion of uniform cross-section about which the associated one of said plurality of coils is wound and a lower portion of increased horizontal cross-sectional area which is secured to said permanent magnet.

3. A release type dot printer head as recited in claim 1, wherein each of said plurality of cores is beveled along an outer side adjacent its attracting face.

4. A release type dot printer head as recited in claim 3, wherein the peripheral surface of each of said plurality of cores is covered with a high strength plastic material, said high strength plastic material extending between each of said plurality of cores and the associated one of said plurality of coils and filling the bevel along the outer side of the core, said high strength plastic material in the bevel acting as said fulcrum for the associated one of said plurality of armatures.

5. A release type dot printer head as recited in claim 1, wherein the peripheral surface of each of said plurality of cores is covered with a high strength plastic material, said high strength plastic material extending between each of said plurality of cores and the associated one of said plurality of coils.

6. A release type dot printer head as recited in claim 1, wherein each of said plurality of armatures is composed of a first part made of a silicon steel material, said first part being in contact with the attracting face of the associated one of said plurality of cores, and a second part made of a carbon steel material, said second part reduced in thickness to reduce its moment of inertia.

7. A release type dot printing head as recited in claim 1, and further comprising:

(a) a guide holder secured to said casing and (b) a plurality of needle guides disposed at axially spaced intervals in said guide holder, said needle guides slidingly receiving said plurality of needles.

8. A release type dot printer head as recited in claim 7 and further comprising a plurality of stops mounted on said guide holder, each of said plurality of stops being positioned to limit working movement of an associated one of said plurality of needles.

9. A release type dot printing head as recited in claim 1, wherein each of said plurality of non-linear springs is a conical spring.

10. A release type dot printing head as recited in claim 1 and further comprising a plurality of stops mounted on said yoke, each of said plurality of stops being positioned to limit return movement of an associated one of said plurality of needles.

11. A release type dot printer head comprising:

(a) a casing;

(b) a permanent magnet secured to an upper face of said casing;

(c) a plurality of cores, each of said plurality of cores being secured to an upper face of said permanent magnet and each of said plurality of cores having an attractive face at the top thereof;

(d) a plurality of coils, each of said plurality of coils being wound around an associated one of said plurality of cores;

(e) a magnetic member secured to the upper surface of said casing and extending inwardly beyond the attractive faces of said plurality of cores, said magnetic member having a plurality of through holes therethrough adjacent to the attractive faces of said plurality of cores, said magnetic member serving as a part of a plurality of side magnet paths which also include said casing and each of said plurality of armatures;

(f) a plurality of armatures, each of said plurality of armatures being disposed for pivotal movement about a fulcrum on said magnet member;

(g) a guide holder secured to said magnetic member;

(h) a plurality of needles, each of said plurality of needles being secured to the inward end of an associated one of said plurality of armatures and being disposed for axially movement in said guide holder;

(i) a plurality of plungers made of a magnetic material, each of said plurality of plungers being secured to an associated one of said plurality of armatures and being positioned to break contact with the attractive face on the unassociated one of said cores as the associated one of said armatures pivots about its fulcrum; and (j) a plurality of non-linear springs, each of said plurality of non-linear springs being disposed between an associated one of said plurality of armatures and said guide holder to resiliently bias the associated one of said armatures for pivotable movement about its fulcrum against the attractive force of said permanent magnetic, which attractive force acts on the associated one of said armatures through its attractive face, said plurality of non-linear springs not being in said side magnetic paths and each of said plurality of non-linear springs being selected so that the torque which it imparts to the associated one of said plurality of armatures as a function of the displacement of the associated one of said plurality of needles approximates the opposite torque imparted to the associated one of said plurality of needles by said permanent magnet.

12. A release type dot printer head as recited in claim 11, wherein said fulcrums are formed on said armatures.

13. A release type dot printing head as recited in claim 11, wherein each of said plurality of cores has an L-shaped configuration comprising an upper portion of uniform cross-section about which the associated one of said plurality of coils is wound and a lower portion of increased horizontal cross-sectional area which is secured to said permanent magnet.

14. A release type dot printing head as recited in claim 11, wherein each of said plurality of non-linear springs is a conical spring.

* * * * *